US010794219B2

(12) United States Patent
Aker et al.

(10) Patent No.: US 10,794,219 B2
(45) Date of Patent: Oct. 6, 2020

(54) AXIAL CASE RING TO MAXIMIZE THRUST BUSHING CONTACT AREA OF VARIABLE VANE

(71) Applicant: Rolls-Royce Corporation, Indianapolis, IN (US)

(72) Inventors: Grace Aker, Indianapolis, IN (US); Alex Ertman, Indianapolis, IN (US); Jonathan Acker, Westfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 245 days.

(21) Appl. No.: 15/704,898

(22) Filed: Sep. 14, 2017

(65) Prior Publication Data

US 2019/0078461 A1 Mar. 14, 2019

(51) Int. Cl.

| | |
|---|---|
| ***F01D 17/16*** | (2006.01) |
| ***F01D 25/24*** | (2006.01) |
| ***F04D 29/56*** | (2006.01) |

(52) U.S. Cl.

CPC ..... *F01D 17/162* (2013.01); *F01D 25/24* (2013.01); *F04D 29/563* (2013.01); *F05D 2230/10* (2013.01); *F05D 2230/60* (2013.01); *F05D 2240/12* (2013.01); *F05D 2240/14* (2013.01); *F05D 2240/50* (2013.01); *F05D 2260/79* (2013.01)

(58) Field of Classification Search

CPC ..... F01D 17/162; F01D 25/24; F04D 29/563; F05D 2230/10; F05D 2230/60; F05D 2240/12; F05D 2240/14; F05D 2240/50; F05D 2260/79

See application file for complete search history.

(56) References Cited

U.S. PATENT DOCUMENTS

| | | | | |
|---|---|---|---|---|
| 3,538,579 | A | 11/1970 | Sprenger | |
| 3,542,484 | A | 11/1970 | Mason | |
| 4,659,295 | A | 4/1987 | Burdette et al. | |
| 5,308,226 | A | 5/1994 | Venkatasubbu et al. | |
| 6,210,106 | B1 | 4/2001 | Hawkins | |
| 6,269,642 | B1 | 8/2001 | Arnold et al. | |
| 6,413,043 | B1 | 7/2002 | Bouyer | |
| 6,474,941 | B2 * | 11/2002 | Dingwell | F01D 17/162 415/160 |

(Continued)

FOREIGN PATENT DOCUMENTS

EP 0545656 A1 6/1993

OTHER PUBLICATIONS

European Patent Office, Extended European Search Report for corresponding EP Application No. 18189499.9 dated Dec. 17, 2018, 10pgs.

(Continued)

*Primary Examiner* — Ninh H. Nguyen
*Assistant Examiner* — Eric J Zamora Alvarez
(74) *Attorney, Agent, or Firm* — Barnes & Thornburg LLP

(57) ABSTRACT

The bearing surface between a thrust bushing and a boss/or face is increased with the addition of a ring or tab that extends radially into a casing bore configured to receive a bushing and cooperating spindle of a variable stator/guide vane. The addition of the ring adds additional bearing surface area without increasing the size of the vane penny, reducing spindle diameter or reducing the bushing bore diameter.

15 Claims, 7 Drawing Sheets

(56) References Cited

U.S. PATENT DOCUMENTS

| | | | | |
|---|---|---|---|---|
| 7,163,369 | B2 | 1/2007 | Bruce | |
| 7,207,770 | B2 * | 4/2007 | Bruce | F01D 17/162 415/160 |
| 8,297,918 | B2 * | 10/2012 | Bhatnagar | F04D 29/563 415/160 |
| 2015/0030438 | A1 | 1/2015 | Takahashi et al. | |

OTHER PUBLICATIONS

European Patent Office Action for Application No. 18189499.9-1004, dated Feb. 25, 2020, 10 pages.

* cited by examiner

AXIAL CASE RING TO MAXIMIZE THRUST BUSHING CONTACT AREA OF VARIABLE VANE

BACKGROUND

A turbofan gas turbine engine used for powering an aircraft in flight typically includes, in serial flow communication, a fan, a low pressure compressor or booster, a high pressure compressor, a combustor, a high pressure turbine, and a low pressure turbine. The combustor generates combustion gases that are channeled in succession to the high pressure turbine where they are expanded to drive the high pressure turbine, and then to the low pressure turbine where they are further expanded to drive the low pressure turbine. The high pressure turbine is drivingly connected to the high pressure compressor via a first rotor shaft, and the low pressure turbine is drivingly connected to both the fan and the low pressure compressor via a second rotor shaft.

The high pressure compressor typically includes a series of stator vane stages used to compress air for engine and aircraft use. The first compressor stage adjacent to the low pressure compressor is the inlet guide vane stage formed of a plurality of circumferentially arranged cantilevered inlet guide vanes. The inlet guide vanes may be actuated through a control system so as to optimize air flow for power and stall avoidance purposes. The guide vanes are retained between a stator case and an inner vane shroud. The stator case is coupled to the engine case. The space between the stator case and the shroud defines the volume of air passing through the high pressure compressor. The shroud provides an aerodynamic flow path boundary of the compressor.

The more the pressure ratio of a compressor is increased the more difficult it becomes to ensure that the compressor will operate efficiently and in a stable manner over the full speed range. This is because the requirement for the ratio of inlet area to exit area at the high-speed operating point results in an inlet area that becomes progressively large relative to the exit area. As the compressor speed and hence pressure ratio reduces, the axial velocity of the inlet air in the stages become low relative to the blade speed; this increases the angle of incidence of the air onto the blades to the point where aerodynamic stall may occur; lift is lost from the aerofoil; and the compressor flow breaks down. Where high pressure ratios are required from a compressor this problem can be overcome by introducing variable inlet guide vanes and variable stator vanes to the stages of the system.

These variable vanes are actuated through the operation of one or more controllable vane actuators. The stator vane stages are located between the compressor blade stages, helping to compress the air forced through the compressor and directing the air flow into the next stage of rotor blades at the proper angle to provide a smooth, even flow through the compressor.

The variable inlet or stator vane, itself, has a base portion (penny) and/or a shaft portion (spindle, trunnion) which extends through the bore and is rotatable therein. A bushing assembly is provided in association with the bore to prevent wear of the casing and the stator vane.

An outer trunnion or spindle of the vane passes through the stator case (casing) and is coupled to a lever arm. The lever arm is coupled to an actuation ring that is connected to a vane actuator. One or more vane actuators effect movement to the series of circumferentially arranged stator vanes of each compressor stage. The vane is typically retained to the stator case through a combination of bushings, washers, and a lock nut that is threaded onto the outer trunnion.

For a variable vane system, low friction material thrust bushings are placed between the vane outer penny and the compressor case penny bore. It is important to maximize the contact area between the thrust bushing and compressor case through actuation to decrease the load required to rotate the vanes. The thrust bushing contact area can be reduced to unacceptable levels as increased vane counts and diminishing radii in the aft stages of the compressor reduce circumferential spacing. Increases in friction in the variable vane system can prevent or interfere with movement of the vanes which could result in engine stall.

SUMMARY

The present disclosure provides a solution to the above-stated problems by mitigating the decrease in bushing contact area with the addition of an integral tab formed in the casing (compressor case). The disclosed subject matter obviates deficiencies in the prior art and presents embodiments with a variable vane system with an arcuate casing and a plurality of vane assemblies arranged circumferentially around the casing. The individual vane assemblies include a penny bore extending radially outward from the inner surface of the arcuate casing; a bushing bore extending radially inward from the outer surface of the arcuate casing; and a spindle bore extending between and connecting the penny bore and the bushing bore. Each of the penny bore, bushing bore and spindle bore share a common axis and the penny bore and the bushing bore have inner diameters greater than the inner diameter of the spindle bore. The variable vane includes a penny with a blade extending from a first side of the penny and a spindle extending from an opposing side of the penny. The vane assemblies further include a bushing seated within the bushing bore, the bushing having an inner diameter less than or equal to the inner diameter of the spindle bore; and a thrust bushing seated in the penny bore, the thrust bushing having an inner diameter equal or greater than the inner diameter of the spindle bore. The penny of the vane is seated on the thrust bushing and the spindle extends through the thrust bushing, through the spindle bore and is seated within the bushing, wherein the variable vane is rotatable about the axis.

The disclosed subject matter also presents further embodiments of a vane system for a turbomachine. The vane system including a casing and a center body defining a gas passage there between; a bore extending through the casing, the bore having a first portion, a second portion and a third portion with the first portion being adjacent to the second portion which is adjacent to the third portion. The second portion of the system has an inner diameter less than the inner diameter of the first and third portions. The bore of the system includes an annular face defined by the interface between the first and second portions, and a thrust bushing is nested in the first portion and seated on the annular face. A vane base is nested within the first portion and seated on the thrust bushing and a vane extends from the vane base into the gas passage and a trunnion extends from the vane base through the second and third portions of the bore. The vane, vane base and trunnion in the system are rotatable with respect to the casing.

The disclosed subject matter further presents embodiments of a method of increasing contact area between a thrust bushing and bearing seat in a variable vane system. The method includes boring a first hole through the annular casing perpendicular to the axis of the casing; boring a second hole into the annular casing perpendicular to the axis, the second hole opening into the outside of the annular casing; and boring a third hole into the annular casing perpendicular to the axis, the third hole opening into the inside of the annular casing. The method further includes placing a thrust bushing in the third hole and inserting a vane assembly into the first second and third holes from the inside of the casing. The penny of the vane assembly is seated on the thrust bushing and a spindle extending from the penning passes through the thrust bushing through the first hole and into the second hole. The method also includes placing a bushing into the second hole and around the spindle, wherein the difference between the diameter of the first hole and the diameter of the second hole results in the increased contact area.

These and other objects and advantages of the present disclosure will be readily apparent to one skilled in the art form a perusal of the claims, the appended drawings and the following detailed description of the preferred embodiments.

BRIEF DESCRIPTION OF THE DRAWINGS

The embodiments will be more readily understood in view of the following description when accompanied by the below figures, which are provided for illustrative purposes, wherein like numerals represent like elements, and wherein.

DETAILED DESCRIPTION

Figure 1:
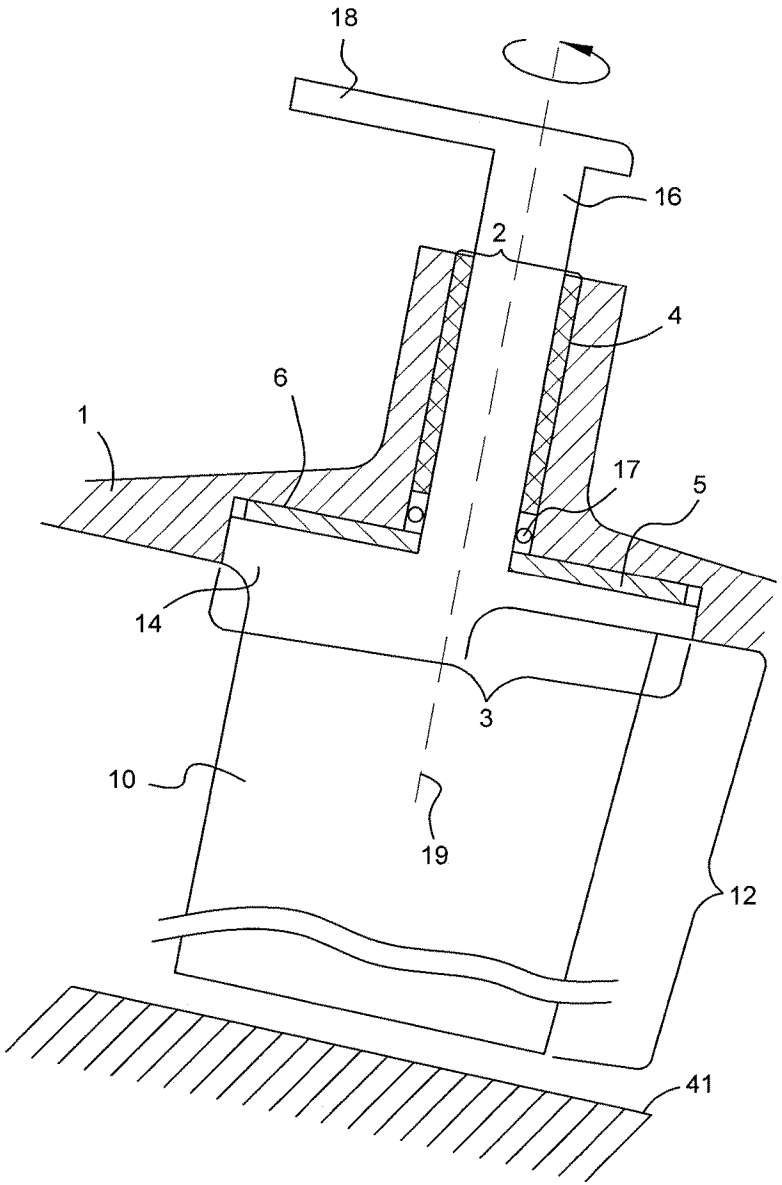
FIG. 1 is a cross sectional view of non-space restricted variable inlet guide vane system.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

FIG. 1 illustrates a cross section of a typical variable vane assembly in which the contact area between the thrust bushing and the bushing seat is not restricted. In FIG. 1 the casing 1 defines a bushing bore 2 and a vane penny bore 3. A bushing 4 is seated in the bushing bore 2 and a thrust bushing 5 is seated within the vane penny bore 3 on face or boss 6.

A vane 10 is received within the casing. The vane 10 has a blade portion 12 that extended beyond the casing 1 into the gas stream defined by center body 41, a vane penny 14 received within the penny bore 3 and seated on the thrust bushing 5. A spindle 16 (trunnion) extends through the thrust bushing 5 and interacts with the bushing 4 to form a journal bearing. A ring seal 17 is also shown about the spindle 16. The spindle 16 is connected to a vane actuator via bell arm 18. The vane as shown in FIG. 1 is rotatable about axis 19.

Figure 2A:
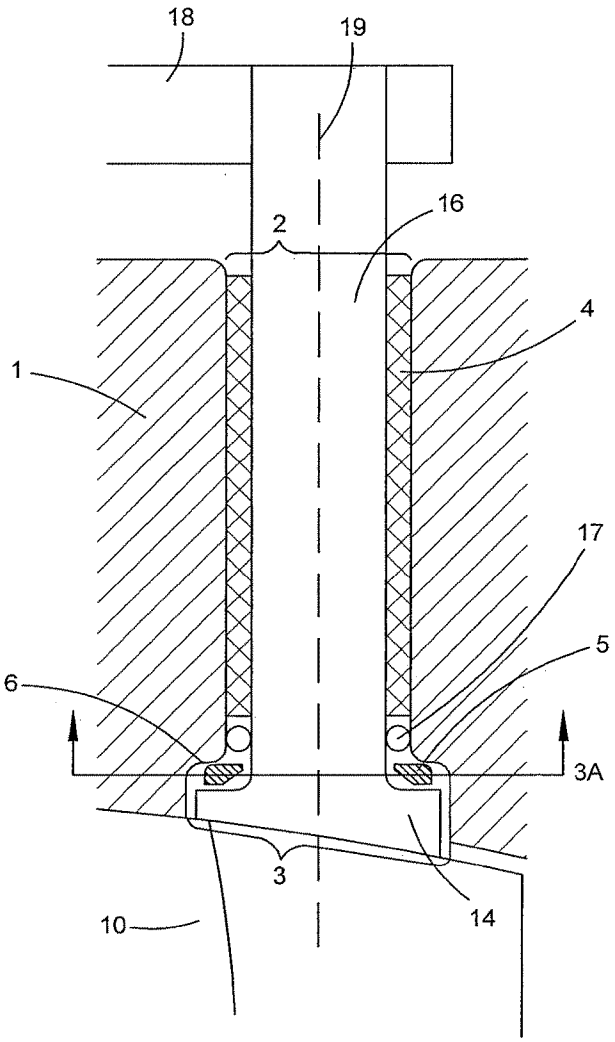
FIG. 2A is a cross sectional view of a space limited variable vane system.

The variable vane assembly shown in FIG. 1 is representative of an inlet guide vane in which the spacing between adjacent vanes is not so restrictive as to unduly reduce the bearing surface of the thrust bushing 5 on the casing boss 6. FIG. 2A illustrates a cross section of a variable vane assembly that is space constrained and the conventional configuration results in a contact area at an unacceptable level. As shown in FIG. 2A the contact surface between the thrust bushing 5 and the boss 6 is significantly reduced. The lack of contact surface increases friction, requiring a larger actuating moment, as well as increases wear.

Figure 2B:
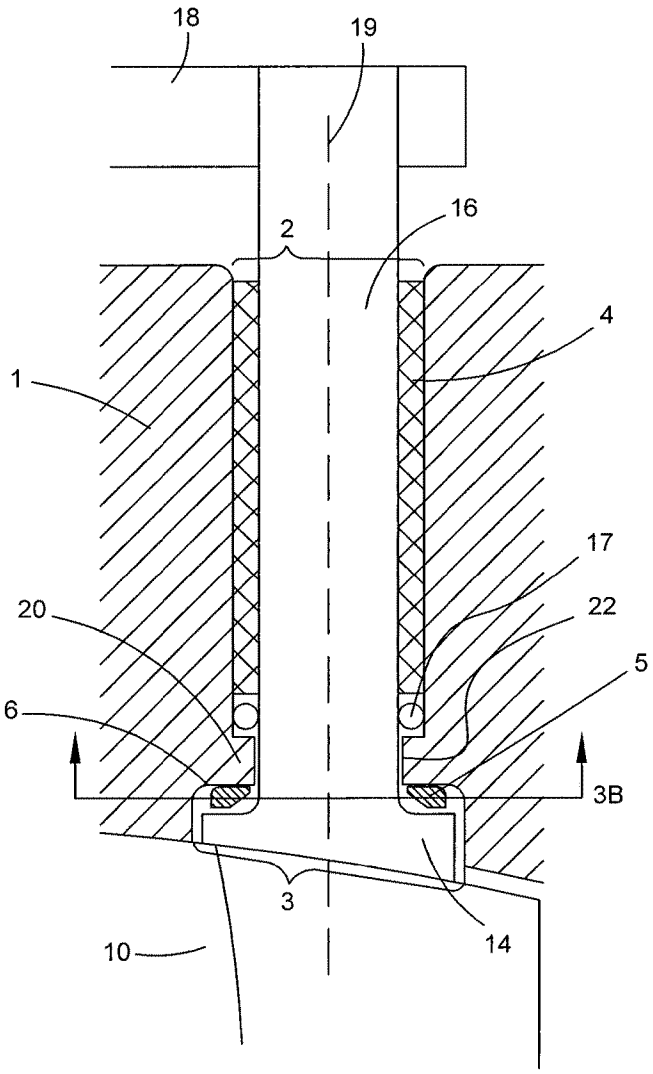
FIG. 2B is a cross sectional view of a space limited variable vane system according to embodiments of the disclosed subject matter.

FIG. 2B illustrates the same space constricted variable vane assembly as shown in FIG. 2A, however modified to include a tab (or ring) 20 within the casing 1 to extend the boss 6 and thus the contact area with the thrust bushing 5. A ring 20, formed from the casing 1, separates the bushing bore 2 and the penny bore 3 and extends radially inward further than the bushing bore 2 to provide an extension of the boss 6 and thus an increase of contact area between the boss 6 and the thrust bushing 5 as compared to FIG. 2A. The ring 20 has ring bore 22 (or spindle bore) with an inner diameter that is greater than the outside diameter of the spindle 16, but less than the inner diameter of both the bushing bore 2 and the vane penny bore 3.

With respect to the embodiment shown in FIG. 2B, the bushing bore 2 is drilled from the outside of the casing 1, whereas the penny bore 3 is drilled from inside the casing. Because the inner diameter of the ring bore 22 is less than either the bushing bore 2, or penny bore 3, the ring bore 22 may be drilled from either side of the casing 1 as well as in any order.

Figure 2C:
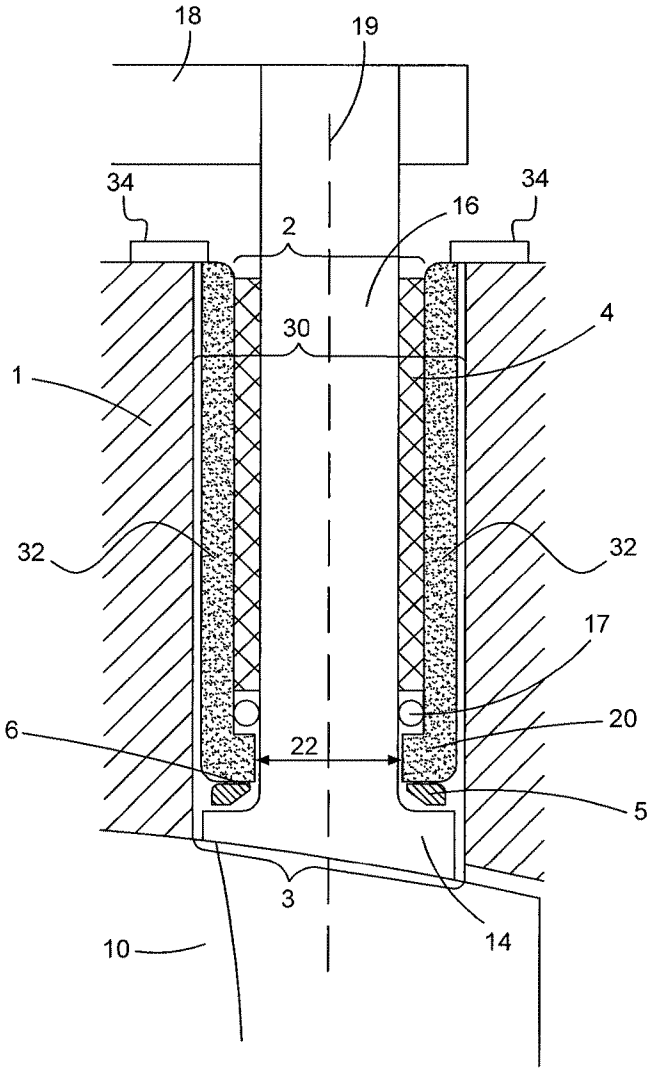
FIG. 2C is a cross sectional view of a space limited variable vane system including a sleeve according to embodiments of the disclosed subject matter.

In an alternative embodiment shown in FIG. 2C, a single bore 30 may be drilled through the casing 1. A sleeve insert 32 defining the bushing bore 2 and the ring 20 and ring bore 22 may be inserted and attached within the single bore 30. The sleeve insert 32 defines the depth of the penny bore 3. In this alternative embodiment the practical requirement for drilling from inside the casing 1 to form the penny bore 3 is removed. A retaining flange 34 may also be incorporated to fix the axial position of the sleeve insert 32. Other mechanisms are also envisioned for attaching the sleeve 32 to the casing 1.

Figure 3A:
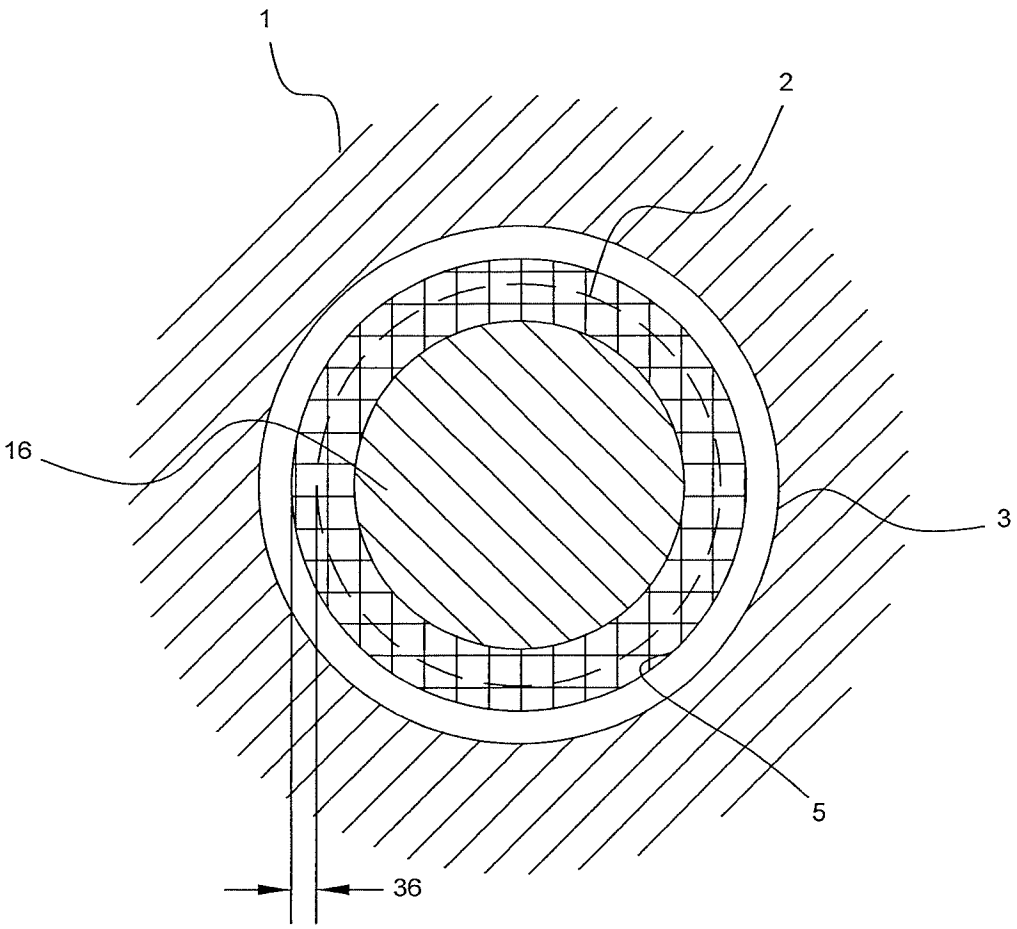
FIGS. 3A and 3B are axial cross sections of FIGS. 2A and 2B respectively.
Figure 3B:
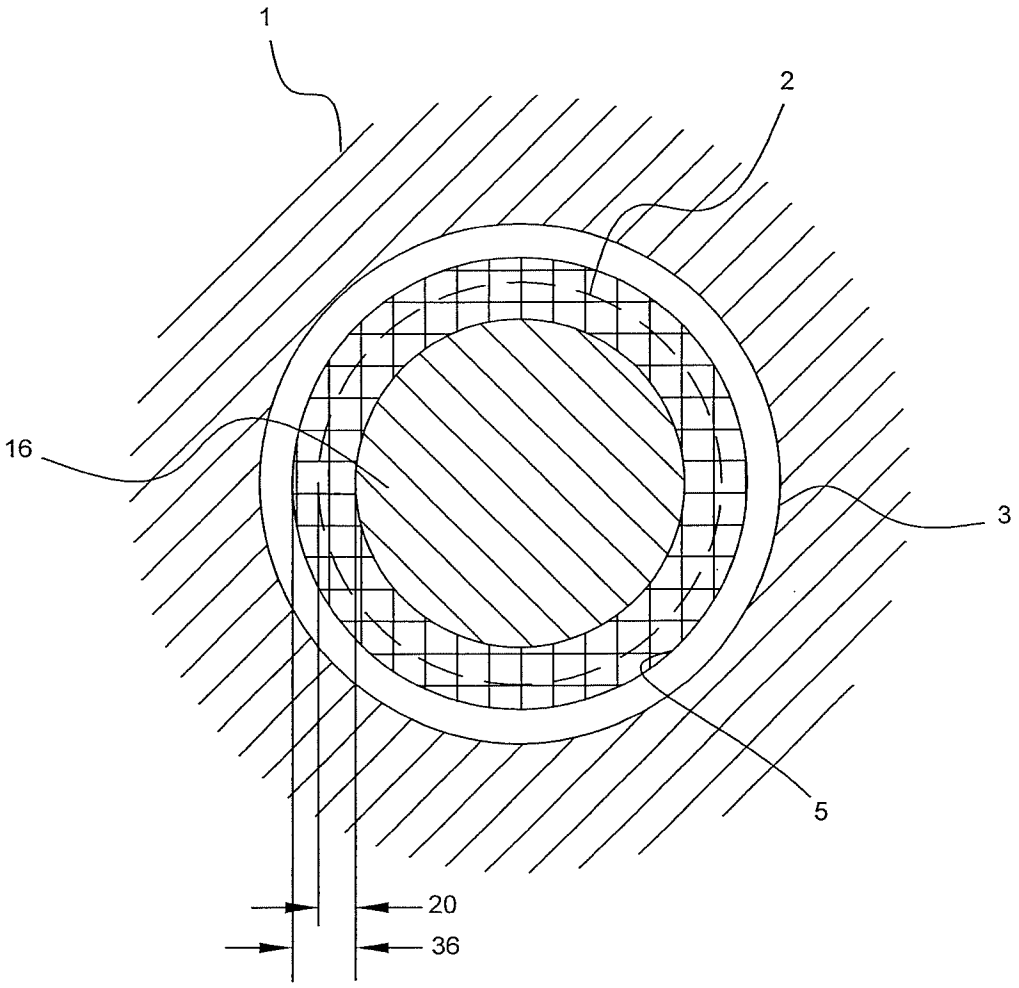

FIGS. 3A and 3B show axial cross sections of FIGS. 2A and 2B respectively. The bearing surface 36 between the thrust bushing 5 and the boss 6 is restricted in FIG. 3A, only catching the outer edge of the thrust bushing 5 as the bushing bore 2 is sized to receive the bushing 4. In FIG. 3B, the bearing surface 36 between the thrust bushing 5 and the boss 6 is substantially larger due to the inclusion of ring 20 which extends radially inward beyond the inner diameter of the bushing bore 2. The inner diameter of the ring bore 22 which in restricted spaces drives the magnitude of the bearing surface 36 is a function of the spindle diameter rather than the outer diameter of the bushing bore 2. The bushing bore 2, penny bore 3, thrust bushing 5, penny 14 and spindle 16 are illustrated to have the same respective size in each of FIGS. 3A and 3B, with the bearing surface 36 increasing from FIG. 3A to FIG. 3B as a result of the ring (or tab) 20. The bearing surface 36 is identified in FIGS. 3A and 3B as a radial span, however it is understood that the radial span is representative of the bearing surface 36, and is labeled as such for convenience and clarity.

While FIG. 3B shows the bushing bore 2 with a smaller inner diameter than the penny bore 3, it is envisioned in some circumstances the bushing bore 2 would have an inner diameter equal to or larger than the penny bore 3, but in all cases the bushing bore 2 and the penny bore 3 would have inner diameters greater than the ring bore 22.

Figure 4:
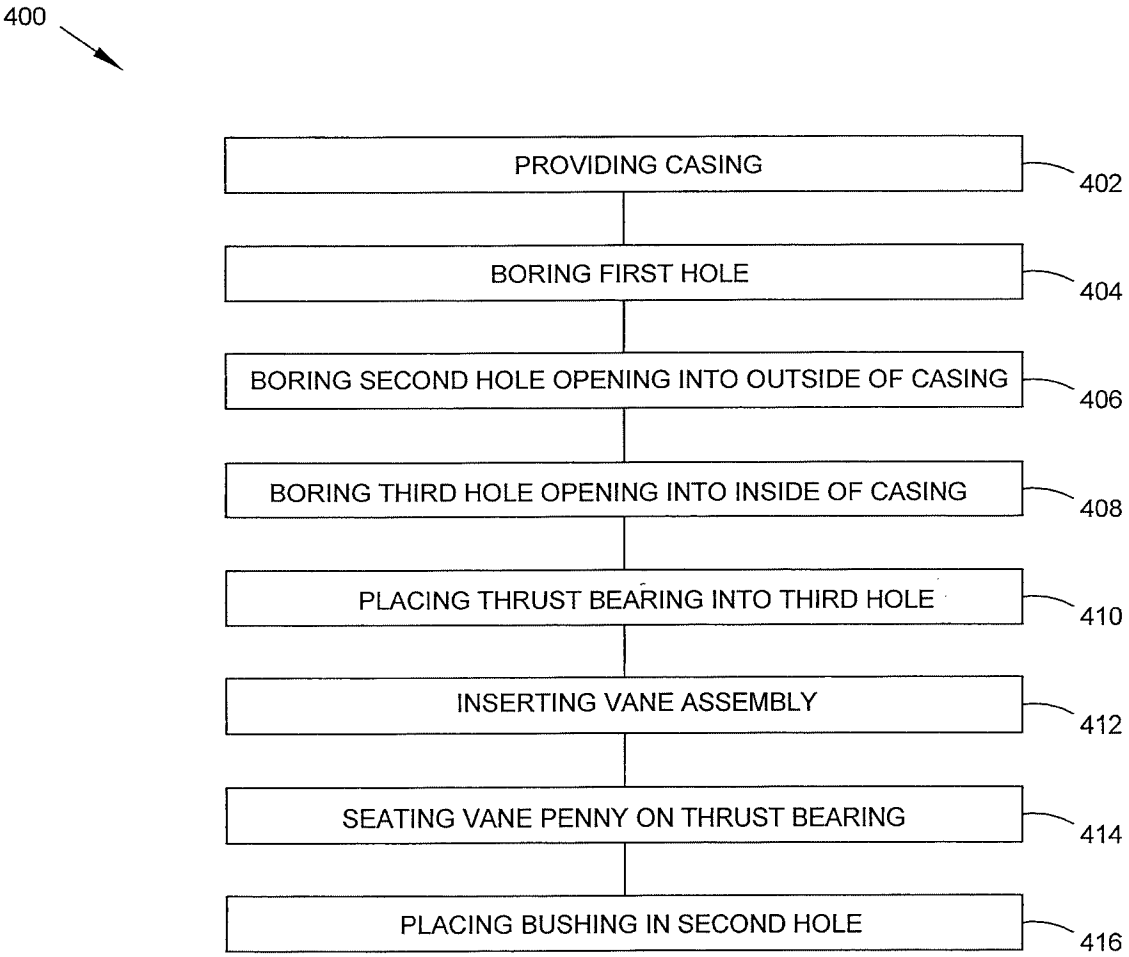
FIG. 4 is a flow chart illustrating a method of increasing the contact area between a thrust bushing and the casing according to embodiments of the disclosed subject matter.

FIG. 4 illustrates a method 400 for increasing the contact surface 36 between the boss 6 and the thrust bushing 5. As shown an outer annular casing is provided in Block 402. The casing is typically casted in halves and subsequently milled. However other known methods of manufacturing the casing are also envisioned.

A first hole or ring bore 22 is bored into the casing as shown in Block 404, the first hole being perpendicular to an axis that defines the annular casing. Typically, the ring bore 22 would have a central axis that would intersect the axis of the casing, however, other orientations where the bores are oblique to and/or do not intersect the casing axis are also envisioned. A second hole or bushing bore 2 is bored into the casing, opening to the outside of the casing as shown in Block 406. The bushing bore 2 shares a central axis with the ring bore 22.

A third hole or penny bore 3 is bored into the casing, opening into the inside as shown in Block 408, the penny bore 3 shares the same central axis with the bushing and ring bores. A thrust bushing 5 is seated inside the penny bore 3 on the boss 6 formed in part by the ring (tab) 20 as shown in Block 410.

The vane assembly is then inserted into the penny bore 3 thrust bushing 5 and ring bore 22 and into the bushing bore 2 from the inside of the casing as shown in Block 412. The penny 14 of the vane assembly is seated on the thrust bushing 5 and the spindle 16 extending from the penny 14 passes through the thrust bushing 5, through the ring bore 22, and into the bushing bore 2 as shown in Block 414.

A bushing 4 is placed into the bushing bore 2 from the outside of the casing and onto the spindle 16 as shown in Block 416. The bushing 4 may be placed into the bushing bore 2 either before or after the vane assembly has been inserted. The difference in diameter between the ring bore 22 and the bushing bore 2 results in an increased bearing surface 36 between the thrust bushing 5 and the boss 6, and thus a reduction of frictional forces required to be overcome to enable rotation of the vane 10.

In manufacturing the embodiment described in FIG. 2C, the boring the penny bore 3 in the casing is completed first and extends through the annular casing. The sleeve 32 is manufactured with the ring bore 22 and the bushing bore 3 and attached and retained within the penny bore 3. The insertion of the sleeve 32 may be from the inside or outside of the casing. Some advantages of the sleeve 32 may be the reduction of bores through the casing, the ability to manufacture the sleeve and respective bores off line, and preassembly of the vane, thrust bushing and bushing prior to insertion into the casing.

An aspect of the disclosed subject matter includes selecting and forming the thrust bushing 5 and bushing 4 from low friction materials as known in the art. Another aspect of the disclosed subject matter is the addition of a button on the vane end opposite the spindle 16. The button is received by a recess in the center body and serves as the other trunnion. The penny typically defines the transition from the vane to the casing on the outer end (most radially extended end) whereas the button is typically at the inner end of the vane (end closest to the center body). However, the location of the assemblies described herein may be reversed with the penny on the center body and the button on the outer casing. Because of the tighter space requirement at the center body as compared to the outer casing, implementations where the penny is at the center body (though rarer) would benefit substantially from the adoption of the disclosed subject matter herein.

The disclose subject matter would be beneficial in all types of turbomachinery, including compressors, turbines, turbochargers, pumps etc. In particular, the disclosed arrangement is advantageous in the latter stages of a compressor where the casing contracts, limiting the space available for the variable vane assemblies.

In describing the subject matter above, use is made extensively of boring to describe the manufacturing step of forming the bores or holes in the casing, however boring as used herein is entitled to the broadest scope to include casting, drilling, milling, grinding, broaching, facing, abrasive jets, laser cutting/gouging and printing.

Although examples are illustrated and described herein, embodiments are nevertheless not limited to the details shown, since various modifications and structural changes may be made therein by those of ordinary skill within the scope and range of equivalents of the claims.

What we claim is:

1. A variable vane system comprising an arcuate casing;

a plurality of vane assemblies arranged circumferentially around the arcuate casing;

each assembly of the plurality of vane assemblies comprising:

a penny bore defined by the arcuate casing, the penny bore extending radially outward from an inner surface of the arcuate casing;

a bushing bore defined by the arcuate casing, the bushing bore extending radially inward from an outer surface of the arcuate casing;

a spindle bore defined by the arcuate casing, the spindle bore extending between and connecting the penny bore and the bushing bore;

the penny bore, bushing bore and spindle bore share a common axis and form a first annular face defined by an interface between the penny bore and the spindle bore, a second annular face defined by an interface between the spindle bore and bushing bore, and an interconnecting face that extends between the first annular face and the second annular face and defines an inner diameter of the spindle bore, and the second annular face being opposite the first annular face;

the penny bore and the bushing bore having respective inner diameters greater than the inner diameter of the spindle bore;

a variable vane having a penny with a blade extending from a first side of the penny and a spindle extending from an opposing side of the penny;

a cylindrical bushing arranged to extend between a first terminal end and a second terminal end, wherein the second terminal end is spaced apart from the first terminal end relative to the common axis and the cylindrical bushing is seated within the bushing bore such that the second terminal end is spaced apart from the second annular face, the cylindrical bushing having an inner diameter less than or equal to the inner diameter of the spindle bore;

a thrust bushing seated in the penny bore, the thrust bushing having an inner diameter equal or greater than the inner diameter of the spindle bore;

wherein the penny is seated on the thrust bushing and the spindle extends through the thrust bushing, through the spindle bore and is seated within the cylindrical bushing, wherein the variable vane is rotatable about the axis; and wherein the vane system further includes a ring seal arranged around the spindle and located between the second terminal end of the cylindrical bushing and the second annular face.

2. The variable vane system of claim 1, wherein an outer diameter of the thrust bushing is equal or less than the inner diameter of the penny bore.

3. The variable vane system of claim 1, wherein the respective spindles of each of the vane assemblies is operably connected to a vane actuator.

4. The variable vane system of claim 1, wherein the variable vane is an inlet guide vane.

5. The variable vane system of claim 1, wherein the variable vane is a stator vane.

6. The variable vane system of claim 5, wherein the stator vane is in the last stage of a multistage turbomachine.

7. The variable vane system of claim 6, wherein the turbomachine is a compressor.

8. The variable vane system of claim 1, wherein the cylindrical bushing is shaped to define an outer surface that faces the bushing bore, an inner surface that faces opposite the outer surface and forms an inner diameter of the cylindrical bushing, a first end surface of the first terminal end that extends between and directly connects the outer surface and the inner surface, and a second end surface of the second terminal end that extends between and directly connects the outer surface and the inner surface, the second end surface being spaced apart from the first end surface and spaced apart from the second annular face.

9. A vane system for a turbomachine comprising: a casing and a center body defining a gas passage there between;

a bore extending through the casing along an axis, the bore having a first portion, a second portion and a third portion; the first portion adjacent to the second portion which is adjacent to the third portion;

the second portion having an inner diameter less than an inner diameter of the first portion, and an inner diameter of the third portion being less than the inner diameter of the first portion;

the bore having a first annular face defined by an interface between the first and second portions, a second annular face defined by an interface between the second and third portions, and an interconnecting face that extends between the first annular face and the second annular face and defines the inner diameter of the second portion, and the second annular face being opposite the first annular face;

a thrust bushing nested in the first portion and seated on the first annular face;

a cylindrical bushing seated within the third portion of the bore and arranged to extend between a first terminal end and a second terminal end, the second terminal end spaced apart from the first terminal end relative to the axis, the cylindrical bushing shaped to define an outer surface that faces the third portion of the bore, an inner surface that faces opposite the outer surface and forms an inner diameter of the cylindrical bushing, a first end surface of the first terminal end that extends between and directly connects the outer surface and the inner surface, and a second end surface of the second terminal end that extends between and directly connects the outer surface and the inner surface, the second end surface being spaced apart from the first end surface;

a vane base nested within the first portion and seated on the thrust bushing;

a vane extending from the vane base into the gas passage and a trunnion extending from the vane base through the second and third portions of the bore, wherein the trunnion extends through the cylindrical bushing;

wherein the vane, vane base and trunnion are rotatable with respect to the casing, and wherein the vane system further includes a ring seal arranged around the trunnion and located between the second end surface of the cylindrical bushing and the second annular face of the bore.

10. The vane system of claim 9, wherein the thrust bushing has an outer diameter equal or less than the inner diameter of the first portion and an inner diameter equal or greater than the inner diameter of the second portion.

11. The vane system of claim 9, wherein the first, second and third portions of the bore are co-axial.

12. The vane system of claim 9, wherein the thrust bushing is made of a low friction material.

13. The vane system of claim 9, wherein the turbomachine is a compressor.

14. The vane system of claim 9, wherein the turbomachine is a turbine.

15. A variable vane system comprising an arcuate casing;

a plurality of vane assemblies arranged circumferentially around the arcuate casing;

each assembly of the plurality of vane assemblies comprising:

a penny bore defined by the arcuate casing, the penny bore extending radially outward from an inner surface of the arcuate casing to a first annular face;

a bushing bore defined by the arcuate casing, the bushing bore extending radially inward from an outer surface of the arcuate casing to a second annular face;

a spindle bore defined by the arcuate casing, the spindle bore shaped to define an interconnecting face that extends between the first annular face and the second annular face and defines an inner diameter of the spindle bore;

the penny bore, bushing bore and spindle bore share the common axis;

the penny bore and the bushing bore having respective inner diameters greater than the inner diameter of the spindle bore;

a variable vane having a penny with a blade extending from a first side of the penny and a spindle extending from an opposing side of the penny;

a cylindrical bushing seated within the bushing bore and arranged to extend between a first terminal end and a second terminal end, the second terminal end spaced apart from the first terminal end relative to the common axis, the cylindrical bushing shaped to define an outer surface that faces the third portion of the bore, an inner surface that faces opposite the outer surface and forms an inner diameter of the cylindrical bushing, a first end surface of the first terminal end that extends between and directly connects the outer surface and the inner surface, and a second end surface of the second terminal end that extends between and directly connects the outer surface and the inner surface, the second end surface being spaced apart from the first end surface and spaced apart from the second annular face;

a thrust bushing seated on the first annular face of penny bore, the thrust bushing having an inner diameter equal or greater than the inner diameter of the spindle bore;

wherein the penny is seated on the thrust bushing and the spindle extends through the thrust bushing, through the spindle bore, and is seated within the cylindrical bushing such that an outer surface of the spindle faces the inner surface of the cylindrical bushing between the first and second terminal ends, wherein the vane system further includes a ring seal arranged around the spindle and located between the second end surface of the cylindrical bushing and the second annular face, and wherein the variable vane is rotatable about the axis.

* * * * *